United States Patent [19]

Grangette et al.

[11] Patent Number: 4,708,720

[45] Date of Patent: Nov. 24, 1987

[54] PROTECTION OF HYDROCARBONS AGAINST THE ACTION OF MICROORGANISMS

[75] Inventors: Henri Grangette, Lyons; Michel Llinares, Saint Genis Laval; Bernard Bossand, Communay; Alain Faure, Saint-Chamond, all of France

[73] Assignee: Societe Anonyme Elf France, France

[21] Appl. No.: 829,405

[22] Filed: Feb. 13, 1986

[30] Foreign Application Priority Data

Feb. 13, 1985 [FR] France ..... 85 02035

[51] Int. Cl.[4] ..... C10L 1/32

[52] U.S. Cl. ..... 44/51

[58] Field of Search ..... 44/51

[56] References Cited

U.S. PATENT DOCUMENTS 4,086,066 4/1978 McDermott ..... 44/51

4,295,859 10/1981 Boehmke ..... 44/51

4,297,107 10/1981 Boehmke ..... 44/51

4,565,548 1/1986 Davis et al. ..... 44/51

OTHER PUBLICATIONS

McCutcheon's Functional Materials, International Ed. 1985, p. 11.

*Primary Examiner*—William R. Dixon, Jr.

*Assistant Examiner*—Margaret B. Medley

*Attorney, Agent, or Firm*—Ostrolenk, Faber, Gerb & Soffen

[57] ABSTRACT

Process for inhibition of microorganisms in liquid hydrocarbons by the introduction of one or more biocidal agents into these hydrocarbons, which also include a small quantity of water and a surface-active compound.

This treatment is particularly useful for preserving liquid hydrocarbons such as petrol, kerosene, gasoline or domestic fuel while being stored.

14 Claims, No Drawings

PROTECTION OF HYDROCARBONS AGAINST THE ACTION OF MICROORGANISMS

The present invention relates to a process and a composition for the inhibition of microorganisms in liquid hydrocarbons. It relates more particularly to hydrocarbons containing water, albeit in the form of traces. It is applicable particularly to industrial liquid hydrocarbons, such as kerosene, petrol, gasoline and other petroleum distillates.

During storage moist hydrocarbons undergo attack from certain microorganisms, in particular aerobic and anaerobic bacteria, alone or accompanied by fungi, in particular yeast. There are a certain number of species of microorganisms for which hydrocarbons constitute a nutrients of choice. These are for example the sulphato-reductive bacteria, such as *Desulfo vibrio* and Desulfatomaculum, as well as phototropic sulphobacteria of the Chlorodiaceae or Rhodospiriuaceae families.

The attack can also arise from bacteria of the chemolithotrophesdia genuses Beggiatoa, Thiotarix, Sulfolobus or Thiobacillus. Mention can also be made by way of example of other species, namely the ferrobacteria such as the sheathed bacteria of the Sphacrolitus or Certothrix genuses, peduncula Gallionella, filamentous Toretaria; Siderocapsaceae; hydrogen oxidising bacteria such as *Micrococcus denitrificans, Pseudomonas facilis, Pseudomonas saccharophila,* Auchandii, Flavo or Ralleronii, fungi such as *Cladosporium resinae, Aspergillus fumigatus,* Alternariaa SPP, Penicillium SPP, Fusarium SPP, *Paecicomyces* variatii and others.

Protection against the action of these various microorganisms is very important, because the development of the latter causes several disadvantages. These are in particular formation of insoluble or gelatinous products at the hydrocarbon-water interface, causing blockage of filters, aspiration strainers, injectors and transfer lines. Also, development of the microorganisms leads to the production of various metabolities, which are capable of inducing a change in the quality of the hydrocarbon; also there can be the formation of oxidised products, reducing certain of the proper characteristics and increasing the tendency to the formation of emulsions because of the production of biosurfactants etc., which can even render impossible utilization of the hydrocarbons. On the other hand, there can be modification of the pH of the aqueous phase present, causing corrosion of storage vessels.

Certain bacteria known as anaerobic corrosion bacteria appear in the thus-modified medium and cause the formation of bacterial growths, which lead to localized corrosion which can even lead to puncturing of the receptacle.

The action of the microorganisms can also lead to gaseous evolution, in particular $H_2S$, $CO_2$, $CH_4$ and others, capable of causing the formation of a foam; this can also affect sealing, particularly in large capacity storage vessels, as is the case in refineries and underground storage facilities; certain characteristics can undergo modifications, for example the content of sulphur compounds known to be corrosive to silver plate.

In the petroluem art, the disadvantages which can arise can thus affect the producer, the refiner, the distributor and the user. The proliferation of microorganisms which takes place initially in the aqueous phase can be propagated depending upon circumstances throughout all the storage facility. Microorganisms develop as a result of small quantities of water which are found in the hydrocarbon and all the more rapidly as the temperature approaches 37° C. Refilling and emptying effected periodically favour seeding. Growth is favoured by the continuous mixing during use of the hydrocarbon; by the mutation of species, in particular the formation of lipotrophic bacteria and/or by the fact of development at the hydrocarbon-water interface, by the production of biosurfactants and the formation of emulsions.

The processes of inhibition of microorganisms known in the prior art only allow partial amelioration of the foregoing disadvantages. In effect, the use of soluble bactericides in the hydrocarbons permits control against the proliferation of lipotrophic organisms, but does not destroy the source of seeding situated in the aqueous phase. Reciprocally, the use of standard water-soluble bactericides allows development of the bacteria in the aqueous phase to be arrested, but remains ineffective vis-a-vis those which have migrated into the hydrocarbon phase.

In the prior art, attempts have been made to remedy this state of affairs by the use of an emulsion of the water-in-oil type, the aqueous phase of which is constituted by a solution of a biocidal salt. Thus U.S. Pat. No. 3,334,976 describes an emulsion of aqueous solutions of K bichromate, borax or Cu sulphate in a petroleum distillate with petroleum sulphonate as the surfactant. However, such emulsions break down with time and the aqueous biocide falls to the bottom of the hydrocarbon; there is thus the disadvantage of water-soluble bactericides mentioned above.

The process according to the present invention allows the disadvantages of the prior art to be obviated and destruction of microorganisms both in the aqueous and hydrocarbon phases, by the use of a single biocidal composition. As most known bactericides are only soluble in water, they can be employed according to the invention even in polluted hydrocarbon reservoirs only containing traces of water.

The process according to the invention, which consists in introducing one or more bactericidal and/or fungicidal agents into hydrocarbon stocks, is characterised in that these agents are accompanied by a certain quantity of water, a surfactant compound and a solvent for the surfactant compound.

Because of the addition of water and the surfactant agent according to the invention, the biocide can diffuse into all polluted parts of the hydrocarbon material to destroy microorganisms; the solvent present has the effect of producing a microemulsion of the biocide, so ensuring stability of the dispersion of the biocide in the hydrocarbon. In this way, no separation of the water occurs.

The process is carried out by the introduction into the hydrocarbon to be treated of a composition characterised in that it consists of a mixture of one or more biocides, particularly bactericides, water, a surfactant agent and the solvent for this surfactant, the weight of water introduced preferably being about half that of the surfactant.

The preferred composition contains by weight:

0.1 to 5% of biocide
0.2 to 6% of water
1 to 12% of the surfactant agent
0.2 to 3% of the solvent, the balance to 100% being constituted by a hydrocarbon, which can be the same as that which is to be protected, for example petrol, kerosene, gasoline, domestic fuel etc., the weight of the surfactant agent preferably being about double that of the water and about four to five times that of the solvent.

The various biocides utilizable against the species which attack hydrocarbons are known in the art; it is thus only by way of non-limitative example that certain numbers of these are cited below.

Quaternary ammonium chlorides and bromides with fatty chains, such as are found in commerce under the mark NORAMIUM; hemi-acetals liberating formaldehyde, for example ethylene glycol bis-semi-formal, which is found in commerce under the name "DASCOCIDE-9", "BODOXIN" and "METATIN"; isothiazolines such as 2-methyl-4-isothiazoline-3-one, such as "KATHON"; triazines, particularly hexahydrotriazine-1,3,5, for example "Cinon"; oxazolidines, for example "Bakzid 2", methylene bis-thiocyanate, Proxid MTC 10; glutaraldehyde Zokalan GDA; salts or chelates of thiohydroxamic acids, for example the sodium salt or the zine 2N oxide chelate 2-mercapto-pyridine, known in commerce as Sodium-Omadine and Zinc-Omadine; chloracetamide such as for example Dehigant LFD.

These various biocides can be utilized alone or in admixtures such that a large spectrum of action is assured vis-à-vis the various microorganisms, particularly bacteria, moulds and fungi. A synergystic action is obtained for example by mixing isothiazoline-one ("Kathon") with the semi-formal of ethylene glycol ("Dascocide 9").

As regards the surfactants which can be utilized according to the invention, these belong to three principal classes, anionic, cationic and nonionic. By way of non-limitative example, various preferred agents are cited below. Petroluem sulphonates of an equivalent average weight of 420 to 520, for example those which are known in commerce under the mark TRS. Alkyl benzene sulphonates of average molecular weight of 405 to 520, such as the Synactos. Oxyethylated or oxypropylated alcohols such as the Ukanils. Oxyethylated nonyl phenols or octyl phenols such as the Synperonics; Sulphosuccinates and their derivatives such as the Aerosols.

The solvents for the surfactants can be alcohols, ethers, esters or ketones. Butyl and isoamyl alcohols and the ethers of ethylene glycol are particularly suitable.

The invention is illustrated by the non-limitative examples which follow:

EXAMPLE 1

A concentrate of a bactericidal solution for gasoline of the following composition is prepared:

| | | |
|---|---|---|
| Gasoline | 95.00% | |
| SYNACTO 247 (sodium alkylbenzene sulphonate of average equivalent weight (PEM) = 520) | 2.25% | |
| Monobutyl ether of ethylene glycol (EMBEG) | 0.75% | |
| Water | 1.12% | |
| DASCOCIDE 9 | 0.80% | (ethylene glycol bis-semiformal) |
| KATHON | 0.08% | (2-methyl 4-isothiazoline-3-one) |

This concentrate is a clear liquid remains stable after storage for three months. 0.1% of this concentrate is added to a gasoline containing $10^7$ microorganisms per ml of an inoculum constituted to the major part by the following bacteria.

| | |
|---|---|
| PARACOCCUS | 89.00% |
| PSEUDOMONAS | 9.50% |
| MICROCOCCUS | 1.25% |
| ARTHROBACTER, ACINETOBACTER, ARWINIA | 0.75% |

in the presence of ASPERGILLUS and reductive sulphato bacteria. At the end of 6 hours, a reduction in the bacterial activity is confirmed, as measured by dosage of the ATP (bioluminescence) which disappears totally after 24 hours of contact.

EXAMPLE 2

A concentrate of a bactericidal solution for gasoline of the following composition is prepared:

| | |
|---|---|
| Gasoline | 85.00% |
| SYNACTO 247 | 7.50% |
| EMBEG | 2.50% |
| Water | 2.80% |
| DASCOCIDE 9 | 2.00% |
| KATHON | 0.20% |

A stable and clear liquid is obtained which, added at the rate of 0.04% to gasoline inoculated with $10^7$ bacteria per ml, reduces the bacterial activity in 6 hours and causes it to disappear completely by 24 hours.

EXAMPLE 3

A bactericidal solution concentrate is made up in gasoline of the following composition:

| | |
|---|---|
| Gasoline | 96.00% |
| SYNACTO 426 sodium alkylbenzene sulphonate (PEM = 405) | 2.25% |
| Isoamyl alcohol | 0.75% |
| Water | 0.56% |
| DASCOCIDE 9 | 0.40% |
| KATHON | 0.04% |

When 0.2% of this concentrate is added to a gasoline inoculated with $10^7$ bacteria per ml, at the end of 6 hours, a reduction is noted in the activity of the bacteria, which disappears completely after 24 hours of contact.

EXAMPLE 4

A concentrate of a bactericidal solution for gasoline has the following composition:

| | |
|---|---|
| Gasoline | 88.3% |
| TRS 18 (sodium petroleum sulphonate PEM = 490) | 3.48% |
| UKANIL 25 ($C_{13}$—$C_{15}$ oxo alcohol + 28 moles of ethylene oxyde) | 3.04% |
| Isoamyl alcohol | 2.18% |
| Water | 1.68% |
| DASCOCIDE 9 | 1.20% |
| KATHON | 0.12% |

When 0.6% of this concentrate is added to a gasoline inoculated with $10^7$ bacteria per ml, the activity of the bacteria reduces after the end of 6 hours; it disappears completely after 24 hours.

EXAMPLE 5

A concentrate of a bactericidal solution for gasoline of the following composition is prepared:

| | |
|---|---|
| motor vehicle petrol | 90.73% |
| TRS 16 (sodium petroleum sulphonate PEM = 440) | 2.71% |
| SYNPERONIC NP6 (nonyl phenol + 6 moles ethylene oxyde) | 2.02% |
| isoamyl alcohol | 2.02% |
| Water | 1.40% |
| DASCOCIDE 9 | 1.00% |
| KATHON | 0.20% |

When 0.075% of this concentrate is added to a gasoline having $10^7$ bacteria per ml, at the end of 6 hours, a reduction is noted in the activity of the bacteria, which disappears completely after 24 hours.

EXAMPLE 6

A concentrate of a bactericidal solution for gasoline has the following composition:

| | |
|---|---|
| Kerosene | 84.5% |
| TRS 16 | 5.60% |
| UKANIL 43 ($C_{13}$—$C_{15}$ oxo alcohol + 7 moles ethylene oxide) | 2.24% |
| Butanol-2 | 3.36% |
| Water | 2.00% |
| METATIN GT | 2.00% |

0.02% of this concentrate added to a gasoline previously inoculated with $10^7$ bacteria per ml reduces after 6 hours the activity of the bacteria, which disappears totally after 24 hours.

EXAMPLE 7

A concentrate of a bactericidal solution for gasoline is prepared, having the composition:

| | |
|---|---|
| Gasoline | 95.05% |
| TRS 18 | 2.42% |
| isopropyl ether of ethylene glycol | 1.03% |
| Water | 0.75% |
| METATIN GT | 0.75% |

It is sufficient for 0.085% of this concentrate in a gasoline inoculated with $10^7$ bacteria per ml to cause all bacterial activity to disappear in 24 hours.

EXAMPLE 8

A concentrate of the bactericidal solution for gasoline of the composition:

| | |
|---|---|
| Domesetic fuel | 90.7% |
| SYNACTO 247 | 4.72% |
| Isopropyl ether of ethylene glycol | 1.58% |
| Water | 1.5% |
| METATIN GT | 1.5% |

is added at the rate of 0.045% to a gasoline previously inoculated with $10^7$ bacteria per ml; after 6 hours, a reduction in the activity of the bacteria is noted, which disappears completely after 24 hours.

EXAMPLE 9

By way of comparison with the foregoing Examples, an aqueous composition is prepared according to the prior art without a surfactant compound and without a solvent. It comprises in weight percent :

| | |
|---|---|
| DASCOCIDE 9 | 1.50 |
| KATHON | 0.12 |
| Water | 98.38% |

To a gasoline previously inoculated with $10^7$ bacteria per ml of the same microorganisms as in Example 2, 0.06% of the above composition is added; but as it is not miscible with the gasoline and deposits at the base of the vessel, it is necessary to agitate with the aid of a stirrer at 600 turns per min to form a homogeneous dispersion. Despite this agitation, after 24 hours, $10^5$ bacteria per ml of the gasolene are still present.

In a test effected without agitation, the population of the microorganisms had practically not changed throughout 24 hours. Compared to the present Example 9, the foregoing Examples 1 to 8 show that the presence of a surfactant, a solvent and small quantities of water make the biocides extremely effective, which are not so vis-à-vis gasoline flora, when they are employed simply in solution in water.

EXAMPLE 10

This is also a comparative test, without surfactant or solvent, where the biocides are utilised in solution in gasoline, as in Examples 1 to 4, but without surfactant, solvent or water. The composition employed contains by weight percent:

| | |
|---|---|
| DASCOCIDE 9 | 1.50 |
| KATHON | 0.12 |
| Gasoline | 98.38 |

A slight haze and a deposit are noted in the gasoline 0.6% of this mixture is added to gasoline previously inoculated with $10^7$ microorganisms per ml, as in the foregoing example. The product then falls to the base of the vessel. After agitation at 600 turns per min, as without agitation, it is noted that the population of microorganisms in the gasoline has not changed after 24 hours.

We claim:

1. Process for the inhibition of microorganisms in a petroleum distillate which comprises introducing into said distillate, a biocidal effective amount of a microemulsion comprising petroleum distillate, 0.1–5% biocide for said microorganism, 0.2–6% water, 1–12% surfactant and 0.2–3% solvent for said surfactant, wherein the surfactant is a petroleum or alkyl benzene sulphonate, or a polyoxyalkylated alcohol or phenol, or sulfosuccinate.

2. Process according to claim 1 wherein the solvent for the surfactant compound is an alcohol, ether, ester or ketone.

3. Process according to claim 2 wherein said solvent is isoamyl alcohol, butanol, monobutylether of ethylene glycol or isopropyl ether of ethylene glycol.

4. Process according to claim 1 wherein the weight of the surfactant is about double that of the water and about 4 to 5 times that of the solvent.

5. Process according to claim 4 wherein said biocide comprises ethylene glycol bis-semiformal or 2-methyl-4-isothiazoline-3-one in an amount of 0.44–2.2%; said surfactant comprises sodium alkyl benzene sulfonate, sodium petroleum sulfonate, ethoxylated $C_{13-15}$ alcohol or ethoxylated nonyl phenol in an amount of 2.25–7.84%; said solvent comprises monobutylether of ethylene glycol, isoamyl alcohol, butanol or isopropyl ether of ethylene glycol, in an amount of 0.75–3.36%; and 0.56–2.8% water.

6. Process according to claim 1 wherein said surfactant is a petroleum sulfonate of equivalent average weight of 420 to 520, alkylbenzene sulfonate of average molecular weight of 405 to 520, oxyethylated alcohol, oxyethylated octyl phenol or oxyethylated nonyl phenol.

7. Process according to claim 1 wherein said biocide is a formaldehyde liberating hemi-acetal, isothiazoline, triazine, oxazolidine, glutaaldehyde or a salt or a chelate of thiohydroxamic acid.

8. Composition for the inhibition of microorganisms in a petroleum distillate comprising a microemulsion of petroleum distillate, 0.1–5% biocide for said microorganism, 0.2–6% water, 1–12% surfactant and 0.2–3% of solvent for said surfactant, wherein the surfactant is a petroleum or alkyl benzene sulphonate, or a polyoxyalkylated alcohol or phenol, or sulfosuccinate.

9. Composition according to claim 8 wherein the weight of surfactant is about double that of the water and about 4 to 5 times of said solvent.

10. Composition according to claim 9 wherein said solvent is an alcohol, ether, ester or ketone.

11. Composition according to claim 9 wherein said surfactant is a petroleum sulfonate of equivalent average weight of 420 to 520, alkylbenzene sulfonate of average molecular weight of 405 to 520, oxyethylated alcohol, oxyethylated octyl phenol or oxyethylated nonyl phenol.

12. Composition according to claim 11 wherein said solvent is isoamyl alcohol, butanol, monobutylether of ethylene glycol or isopropyl ether of ethylene glycol.

13. Composition according to claim 12 wherein said biocide is a formaldehyde liberating hemi-acetal, isothiazoline, triazine, oxazolidine, glutaaldehyde or a salt or a chelate of thiohydroxamic acid.

14. Composition according to claim 9 wherein wherein said biocide comprises ethylene glycol bis-semiformal or 2-methyl-4-isotiazoline-3-one in an amount of 0.44–2.2%; said surfactant comprises sodium alkyl benzene sulfonate, sodium petroleum sulfonate, ethoxylated $C_{13-15}$ alcohol or ethoxylated nonyl phenol in an amount of 2.25–7.84%; said solvent comprises sodium monobutylether of ethylene glycol, isoamyl alcohol, butanol or isopropyl ether of ethylene glycol, in an amount of 0.75–3.36%; and 0.56–2.8% water.

* * * * *